US007334742B2

(12) United States Patent
Jahnke et al.

(10) Patent No.: US 7,334,742 B2
(45) Date of Patent: Feb. 26, 2008

(54) SPRAYING DEVICE WITH DROPLET HOLD-BACK

(75) Inventors: Horst Jahnke, Groenwohld (DE); Torsten Witting, Buchholz (DE); Christian Thieme, Hagenow (DE)

(73) Assignee: Airbus Deutschland GmbH (DE)

( * ) Notice: Subject to any disclaimer, the term of this patent is extended or adjusted under 35 U.S.C. 154(b) by 241 days.

(21) Appl. No.: 11/177,081

(22) Filed: Jul. 8, 2005

(65) Prior Publication Data

US 2006/0011747 A1 Jan. 19, 2006

Related U.S. Application Data

(60) Provisional application No. 60/586,966, filed on Jul. 9, 2004.

(30) Foreign Application Priority Data

Jul. 9, 2004 (DE) ..... 10 2004 033 338

(51) Int. Cl.

| | |
|---|---|
| ***B05B 15/02*** | (2006.01) |
| ***F23D 11/34*** | (2006.01) |
| ***F23D 11/38*** | (2006.01) |
| ***F23D 1/28*** | (2006.01) |
| *A62C 13/62* | (2006.01) |
| *A62C 13/66* | (2006.01) |
| *A62C 35/58* | (2006.01) |
| *B05B 9/03* | (2006.01) |

(52) U.S. Cl. ..... 239/120; 239/106; 239/124; 239/302; 239/525

(58) Field of Classification Search ..... 239/589, 239/302, 105, 108, 120, 121, 122, 124, 126, 239/290, 291; 118/323, 326; 15/231, 256.5
See application file for complete search history.

(56) References Cited

U.S. PATENT DOCUMENTS

| | | | | |
|---|---|---|---|---|
| 2,270,579 | A | 1/1942 | Chamberlin et al. | 15/4 |
| 2,488,195 | A | 11/1949 | Ivey | 299/58 |
| 4,196,857 | A * | 4/1980 | Bauer | 239/327 |
| 4,397,259 | A | 8/1983 | Kanda et al. | 118/323 |
| 4,620,669 | A * | 11/1986 | Polk | 239/120 |
| 4,700,890 | A * | 10/1987 | Hasegawa | 239/103 |
| 4,767,056 | A * | 8/1988 | Demetrius et al. | 239/288 |
| 5,989,639 | A * | 11/1999 | Person | 427/356 |
| 6,074,135 | A | 6/2000 | Tapphorn et al. | 406/46 |
| 6,938,838 | B2 * | 9/2005 | Kawamoto | 239/504 |
| 2004/0016824 | A1 | 1/2004 | Kawamoto | 239/302 |

FOREIGN PATENT DOCUMENTS

| | | |
|---|---|---|
| DE | 26 57 445 A1 | 7/1977 |
| DE | 29 08 004 A1 | 9/1980 |
| DE | 38 27 251 C2 | 6/1993 |
| WO | WO 01/34309 A2 | 5/2001 |

* cited by examiner

*Primary Examiner*—Kevin Shaver
*Assistant Examiner*—James S. Hogan
(74) *Attorney, Agent, or Firm*—Ostrolenk, Faber, Gerb & Soffen, LLP

(57) ABSTRACT

The present application describes a spraying device with droplet hold-back. The droplet hold-back is formed by a baffle, which collects the droplets in a defined volume. From this volume, the droplets can be suctioned by means of a suction opening and supplied to a filter system for purification. In this manner, a purified air can be supplied again to the surrounding air.

16 Claims, 8 Drawing Sheets

SPRAYING DEVICE WITH DROPLET HOLD-BACK

REFERENCE TO RELATED APPLICATIONS

This application claims the benefit of the filing date of the U.S. Provisional Patent Application No. 60/586,966, filed Jul. 9, 2004, and of Germany Patent Application No. 10 2004 033 338.6, filed Jul. 9, 2004, the disclosure of which is hereby incorporated by reference.

FIELD OF THE INVENTION

The present invention relates to a spraying device. In particular, the invention relates to a spraying device, which can be used for coating surfaces. In particular, the present invention relates to a spraying device, which can be used in the manufacturing and repair of aircraft surfaces and a method for coating surfaces.

BACKGROUND OF THE INVENTION

For the application of material onto the surface of aircraft parts, standard spraying devices are currently used. These can be HVLP (high volume-low pressure) spraying pistols, for example, that are operated by air. These spraying pistols are used in assembly as well as in the repair of defective parts. Generally, the work takes place in large halls, and at the same time as the surface treatment, other assembly teams are in the hall with other jobs. Upon spraying of the material, an overspray of the finest atomized droplets exits into the air. These droplets include particles of the material, which do not remain adhered to the surface to be sprayed. The dispersion of these droplets moving freely in the room can not be predetermined and it can hardly be detected in the room. Since the material to be sprayed can contain chromate and toxic solutions (toluene, xylene, isocyanate), the unhindered dispersion is problematic and during the application, breathing protection devices are used. Also, in practice, in adjacent areas, no other procedures can be performed. In addition, the possibility exists that chromate-containing solid particles can accumulate and therefore, an increased cleaning expense is required, before other work can be performed again without breathing protection devices.

SUMMARY OF THE INVENTION

According to an exemplary embodiment of the present invention, a spraying device is provided. The spraying device includes a baffle and a spray head. The spray head is arranged in the baffle and dispenses droplets. In this manner, the baffle prevents the dispersion of the droplets in at least one unwanted direction.

This embodiment of the present invention may make it possible that the droplets, which, for example, do not remain adhered to the surface of the material, are not immediately dispersed in the unwanted direction.

According to a further exemplary embodiment of the present invention, the baffle has an inner and an outer side, whereby on the inner side, a volume is formed, into which the spray head sprays the droplets.

By means of the injection of the droplets into the volume formed by the baffle, the droplets sprayed by the spray head into the volume are enclosed. That is, the droplets, which are finely sprayed upon injection and form an overspray, can remain only in the volume formed by the baffle and therefore, can be localized in a known manner. The movement of the droplets within the volume may be chaotic (or circular), but the droplets are prevented essentially by means of the baffles from going outside of the volume.

According to a further exemplary embodiment of the present invention, air is located in the volume, which contains the droplets as a mist. At least a part of the air can be suctioned by means of a suction or extraction device from the volume.

The droplets released into the air by the suction device prevent the droplets from diffusing or escaping from the volume which encloses the droplets. An outward diffusing at locations would be possible where the prevention of the dispersion into the unwanted direction is possible in only a limited manner, for example, at joints at which the spray head is arranged in the baffle or on the contact surfaces of the bell-shaped baffle on the surface to be sprayed. In particular, a good sealing of the "spraying bell" against the surface to be sprayed on contoured surfaces is problematic. The suctioning of the droplets from the volume prevents too much accumulation of droplets in the volume. By means of the injection of additional droplets through the spray head, an accumulation of the droplets in the volume would occur. The air with the droplets which is suctioned from the volume form a suction flow. The suction may offer the advantage that the suction flow in which the droplets are located can be treated further specifically, for example, the suction flow can be supplied to a filter system for purification. In this filter system, the drops could be removed from the suctioned air. The suctioning and cleaning of the air and therewith, the prevention of the droplets from moving outside of the volume formed by the baffle permits that other work likewise can occur around the spraying process, which are not affected by the droplets exiting from the volume. In addition, otherwise necessary breathing protection devices can be eliminated in the work occurring in the surrounding areas.

According to a further exemplary embodiment of the present invention, at least one opening is formed in the baffle, which forms a connection between the inner side and the outer side of the baffle.

This opening may make possible an air supply from the outer side of the baffle to the inner side of the baffle. By means of the suction process, a vacuum is produced in the interior of the volume formed by the baffle. In this manner, air from the outside of the baffle can be suctioned in and transported into the volume. Since this suctioning is directed from the outside in the direction of the inside, it is additionally prevented that droplets can move from the inside to the outside. The droplets can move only in the air. Thus, also they could move outwardly only into the air which is provided in the opening when they are in the vicinity of the opening. Indeed, this air is directed from the suctioning into the direction of the inside of the volume and pulls therewith each droplet which would like to move onto the outside back into the volume, from where it is suctioned with the air.

According to a further exemplary embodiment of the present invention, in the region of the volume, a suction opening is provided. This suction opening is arranged in a first distance of the spray head along the dispersion axis of the droplets and in a second distance perpendicular to the dispersion axis of the droplets. On the suction opening, a suction device is provided, such that the suction opening and the suction device cooperate with one another.

The spray head may make it possible, for example, to apply droplets onto a material to be coated, which is located opposite the spray head. For uniform application of the droplets, the droplets are sprayed from the spray head and accelerated in the direction of the material to be coated. A jet exists, formed from air and droplets, which moves in the direction of the material to be coated and broadens in this direction. Because of reflections, droplets move outside of the jet and therefore can no longer be used to coat the material. In an advantageous manner, these droplets are suctioned via a suction device in the region of the volume. In order to allow for the broadening of the jet and to take into consideration that the droplets must be able to move from the spray head onto the oppositely disposed material to be coated, the suction opening is arranged in a first distance from the spray head in the dispersion axis of the droplets and in a second distance perpendicular to the dispersion axis of the droplets, and thereby permits in an advantageous manner an unhindered spraying of the surface.

According to a further exemplary embodiment of the present invention, on the spraying device, a handle is mounted. In an advantageous manner, this handle facilitates the holding and controlled movement of the spraying device during the spraying process such that the spraying device can easily be handled manually.

According to a further exemplary embodiment of the present invention, the spraying device is coupled with a base station, which comprises an exhaust fan, at least one exchangeable filter unit, at least one valve element, at least one control element, at least one operator element, a material pressure vessel, at least one connection for compressed air, and at least one connection for a voltage supply.

Therefore, functional elements of the spraying device can be combined in an external unit, so that they need not be provided on the spraying device itself, whereby the manipulation of the spraying device is facilitated.

According to a further exemplary embodiment of the present invention, the spray head is provided with a roller system. In this manner, the spraying device can be offset parallel to the surface to be sprayed. By adjustment of the roller system, for example, a distance between the baffle and the surface can be adjusted and can be retained constantly upon movement.

According to a further exemplary embodiment of the present invention, a method for spraying with a spraying device is provided. During the spraying on of the droplets by means of a spray head onto a surface to be spray, a baffle is provided, which prevents a dispersion direction of the droplets.

It may be achieved with this method that the droplets collect on one side, which is formed by the baffle. In this manner, the droplets can be better localized.

According to a further exemplary embodiment, the method for spraying with a spraying device includes the suctioning of the droplets from a volume formed by the baffle and the spray head through a suction opening. In this regard, the suction opening is arranged in a first distance from the spray head in the dispersion axis of the droplets and in a second distance perpendicular to the dispersion axis of the droplets.

Therefore, droplets which do not remain on the surface to be sprayed are suctioned out of the volume.

SHORT DESCRIPTION OF THE DRAWINGS

Next, embodiments of the present invention will be described in greater detail with reference to the accompanying figures. In the drawings.

DESCRIPTION OF PREFERRED EMBODIMENTS OF THE INVENTION

Figure 1:
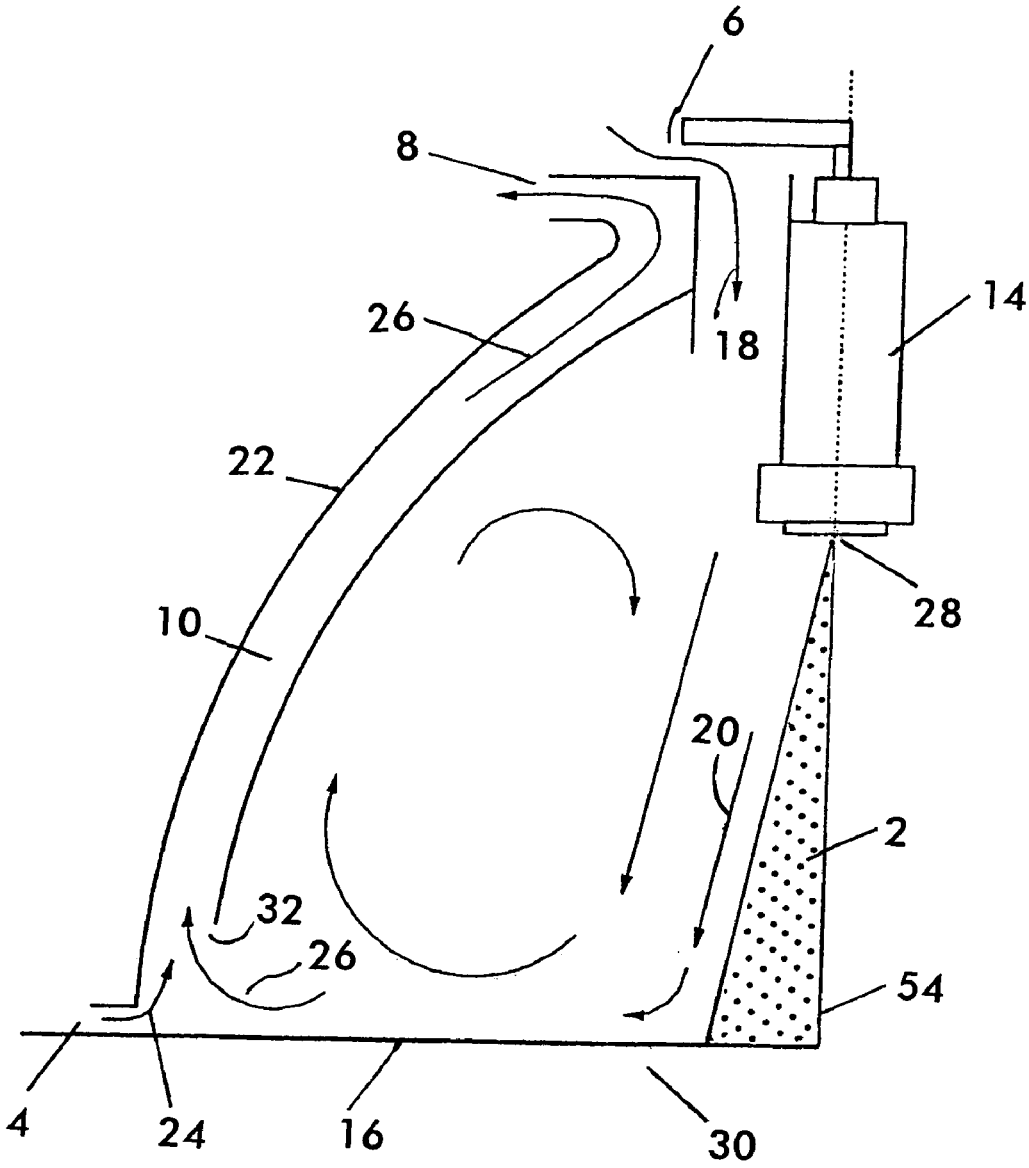
FIG. 1 shows a two-dimensional local section representation of a spraying device according to an exemplary embodiment of the present invention.

FIG. 1 shows a two-dimensional partial view representation according to an exemplary embodiment of the present invention. The surface 16 of a material 30 that is to be sprayed by means of the spray head 14 can be seen, which for example can be the outer shell of an aircraft fuselage. The shape and surface properties of the material 30 can therefore be arbitrary. The spray head 14 has a spraying direction, whereby the spray head is arranged with reference to the spraying direction in the baffle 22 at a right angle to the material surface 16 and the spray head 14 sprays droplets, for example paint or coating lacquer, by means of compressed air onto the surface 16. The spray head 14 is arranged in the baffle 22, such that it can be dismantled easily from the baffle 22 for cleaning and maintenance purposes and accelerates the droplets in the direction of the surface 16, whereby a jet 2 comprised of paint and air forms, whose diameter in the region of the spray head outlet 28 is smaller than the diameter in the region of the surface 16 to be sprayed, which is perpendicularly oppositely disposed. The widening of the jet exists by turbulence effects upon exiting of the droplets from the spray head 14 on the spray head outlet 28, so that the droplets essentially follow the designated direction 20 on their way to the surface 16 to be sprayed.

There are also droplets, however, because of too intense turbulence on the spray head outlet 28 or also because of reflection on the surface 16, which do not follow the course of the direction 20, but which disperse finely into the air and collect as overspray in the fine dispersion region 12. This fine dispersion region 12 essentially is defined by the widened jet 2, the spray head 14, and the baffle 22. The baffle 22 is bell-shaped and has in the region of the spray head 14 a narrower diameter than in the area of the surface 16 and accounts for the widening of the jet 2. Droplets, which are located in the fine dispersion region 12 outside of the jet 2 can no longer be used for treatment of the surface 16 and represent a mist made of toxic waste material, since it often contains chromate and toxic solutions, such as toluene, xylene, isocyanate. So that this mist cannot move outside of the baffle 22 and to prevent droplets accumulated in the region 12 upon further spraying from accumulating too much, it is provided in the device shown that the mist of droplets and air found in the fine dispersion region 12 is suctioned out via the opening 32.

The opening 32 in the baffle is formed, such that it has on the inner side of the baffle 22 a greater distance to the surface 16 to be sprayed then the outer side of the baffle 22. In this manner, the mist formed in the fine dispersion region 12 is suctioned. It thereby follows the suction flow 26. This leads through the suction channel 10, which is formed between the inner and outer side of the baffle 22 to the suction opening 8, on which, for example, a suction tube is connected. In order to prevent the formation of a vacuum in the volume formed by the baffle 22 from the suctioning, openings 4, 6 for the air supply are provided. The inflowing air 18, 24 replaces the dirty air suctioned from the volume. The movement direction of the supply air 18, 24 is directed in the inner region of the volume formed by the baffle 22 and prevents an outward diffusion from this region of the mist located in the fine dispersion region 12. The openings for air supply 4, 6 can be formed for example by slots in the baffle 22 or also by a spacer 36 mounted on the baffle 22.

Figure 2:
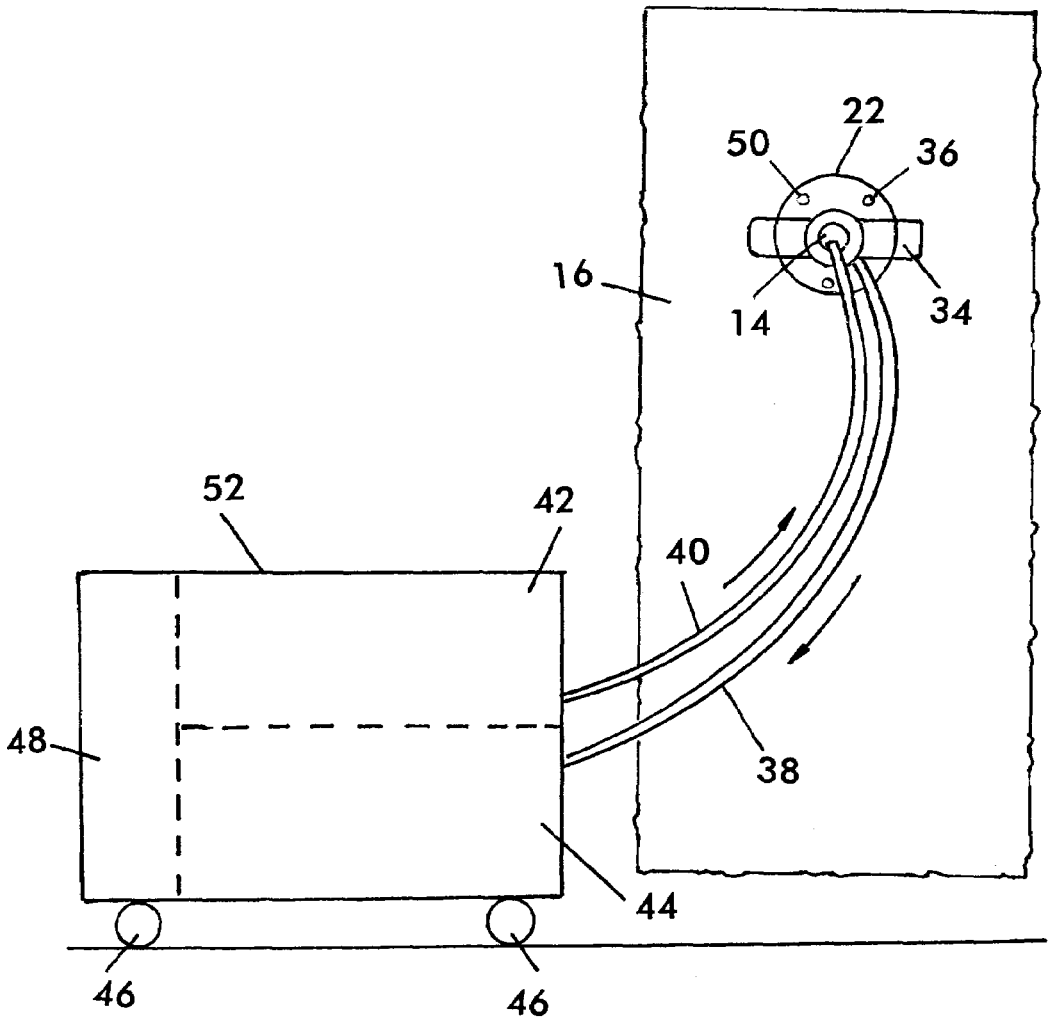
FIG. 2 shows a two-dimensional principle representation of an embodiment according to an exemplary embodiment of the present invention.

FIG. 2 shows a two-dimensional principle representation of an exemplary embodiment according to the present invention. FIG. 2 shows how the spraying device 50 is applied on the surface 16 to be sprayed. The handle 34 can serve for simple manipulation during the spraying process and for better positioning of the spraying device. By means of two connection lines 40, 38, the spraying device is connected with a base station 52. The connection line 40 serves for the material supply and the compressed air supply for the spray head 14. The mist comprised in part of toxic droplets and air from the volume formed by the baffle 22 is suctioned via the suction line 38 from the spraying device. An exhaust fan 44, which is accommodated in the base station 52, generates the suction. The partially toxic mist suction from this is supplied to the filter unit 48, in which it is cleaned. The air is released from the droplets, whereby the droplets can be collected separately and the cleaned air, for example, can be supplied again to the surrounding air. In addition to the exhaust fan 44 and filter unit 48, also a material pressure vessel 42 is disposed in the base station and control and operating elements. The material pressure vessel 42 is connected with the material supply line 40 and supplies the spraying device 50 and in particular, the spray head 14 with the material to be sprayed and the pressure required therefor. The integration of the functions that are not directly required in the spraying process into a base station is notable upon manipulation of the spraying device, since the spraying device is thereby essentially lightened and can be moved for example more easily over the material surface 16. In order for the spraying device and the base station not to be location-bound, the base station is supported on wheels 46, whereby it can be moved to each location of use.

Figure 3:
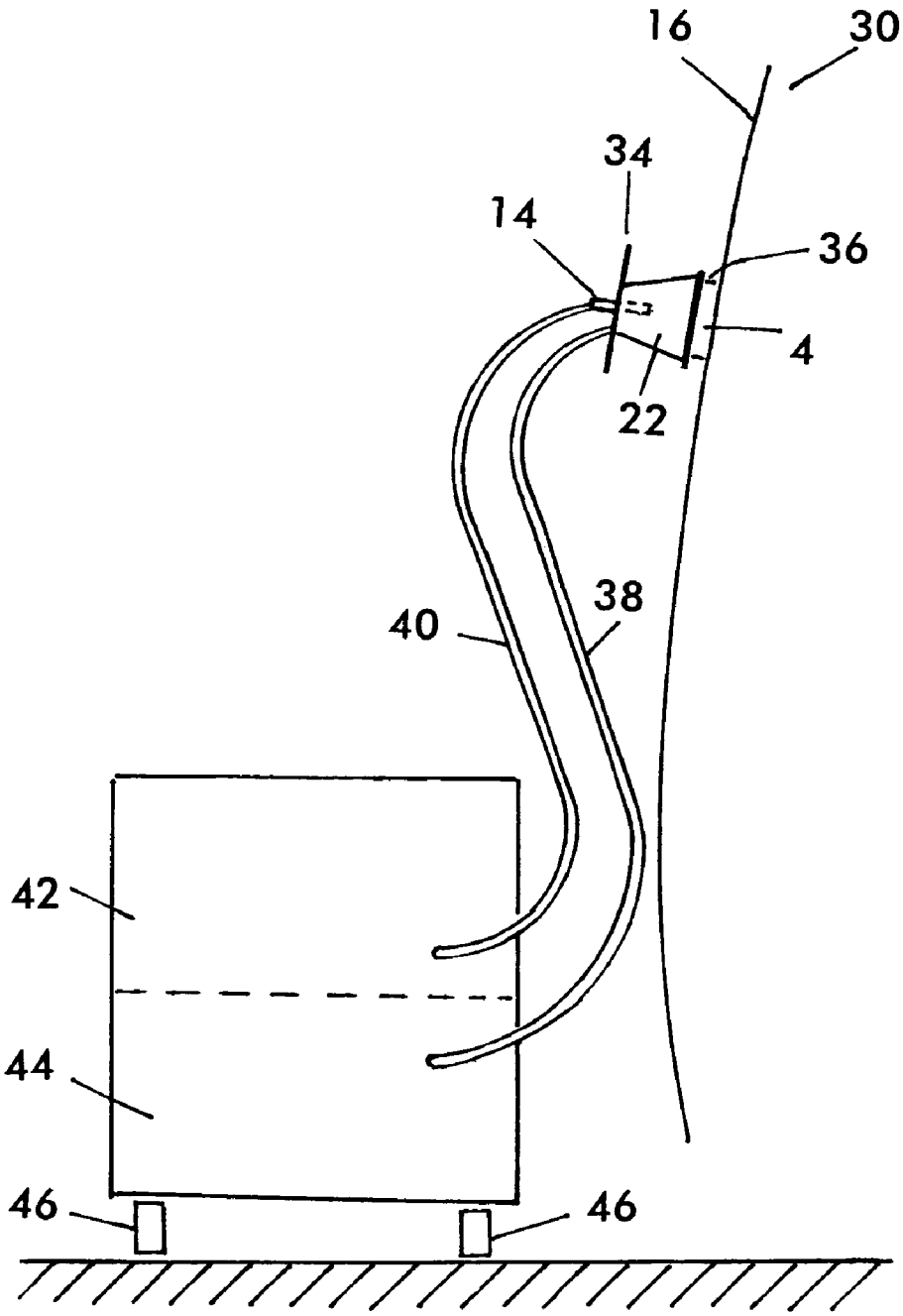
FIG. 3 shows a further two-dimensional principle representation of an exemplary embodiment according to the present invention.

FIG. 3 shows a further principle representation of an exemplary embodiment according to the present invention. It shows how by means of spacers 36, which are formed on the region of the baffle 22 facing the material to be sprayed, a distance 4 between the material surface 16 to be sprayed and the baffle 22 exists, which serves to supply air. In the interior of the volume formed by the baffle 22, supply air flows through the gap 4, since the exhaust fan 44 produces a vacuum via the suction line 38 in the volume formed by the baffle 22. By way of example for the different surface shapes 16 to be treated, a curved surface is shown in FIG. 3, like that which can occur with the outer shell of the fuselage of an aircraft.

Figure 4:
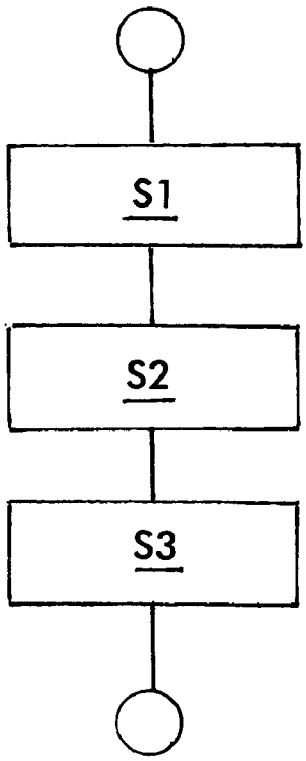
FIG. 4 shows a flow diagram of a method according to an exemplary embodiment of the present invention.

FIG. 4 shows a flow diagram of an exemplary embodiment of a method for spraying with a spraying device. In a first step S1, droplets are sprayed onto a surface 16 to be sprayed by means of a spray head 14. These droplets can be distributed more or less chaotically in the room. Therefore, in the next step S2, by providing a baffle 22, a dispersion direction of the droplets is prevented. In order to prevent that the droplets are collected in a specific region, in step S3, the droplets are suctioned from this region, in particular from a volume formed by the baffle 22 and the spray head 14, through a suction opening 32. The suctioning takes place in a first distance from the spray head 14 in the dispersion axis of the droplets and in a second distance to the dispersion axis of the droplets. The suctioned air moves over a suction line 38 and an exhaust fan 44 into a filter unit 48, is cleaned there, and can be supplied further to the surrounding air without the partially toxic droplets.

In the following description of FIGS. 5 through 11, the same reference numerals are used for the same or corresponding elements.

Figure 5:
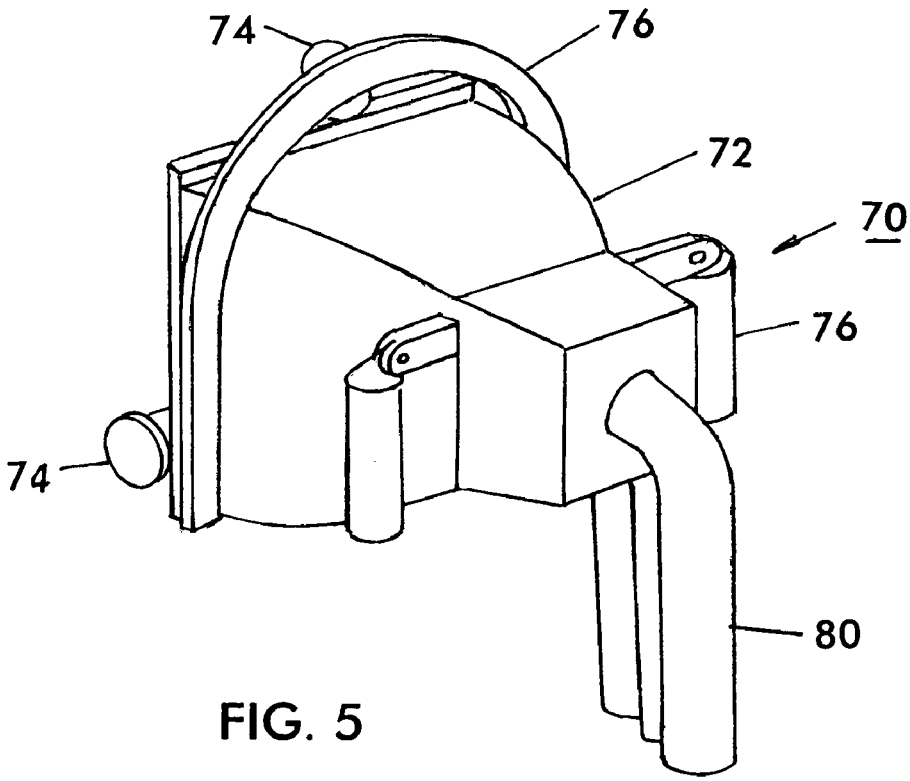
FIG. 5 shows a further exemplary embodiment of a spray head according to the present invention.

FIG. 5 shows a further exemplary embodiment of a spray head 70 according to the present invention. The spray head 70 has a bell-shaped spraying capsule 72, which here has a square cross section, into which the spraying pistol (not shown) injects the main jet. The capsule 72 further has a roller system 74, which permits a hand-guiding of the spray head 70 parallel to the surface with a constant distance. For example, three different rollers, which are arranged on the corners of a triangle, can be provided. With such a three-point roller system, with manual attachment, a defined column distance to the surface to be sprayed is realized, whereby damage to the surface can be avoided. In order to permits simple guiding of the spray head 70 for example, by hand, handholds 76 are provided. For supplying the spraying material or for suctioning the suction air, tubes 80 are provided.

Figure 6:
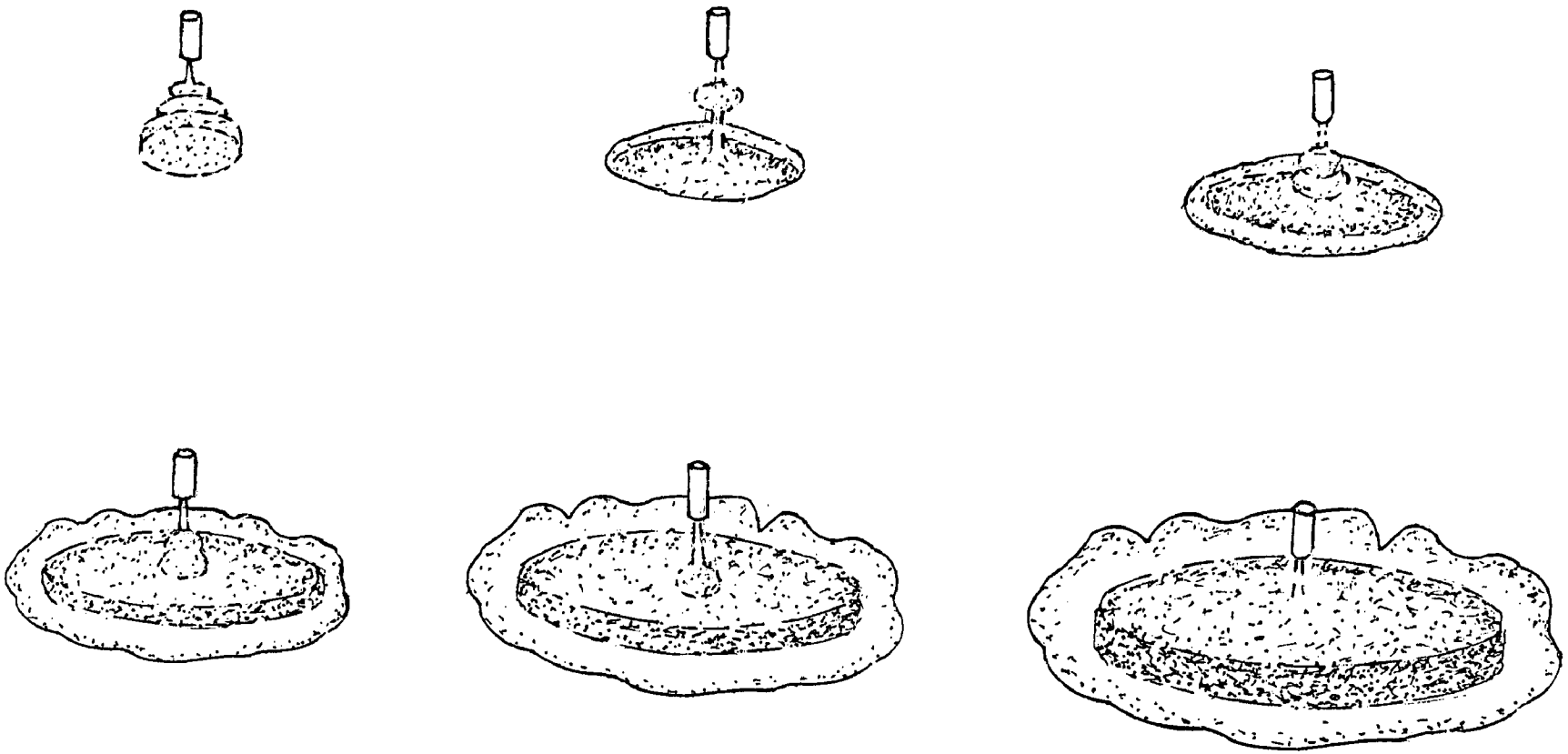
FIG. 6 shows a dispersion of an overspray cloud with free spraying for further clarification of a manner of functioning of an exemplary embodiment of the present invention.

FIG. 6 shows an expansion of an overspray cloud with free spraying with a spraying pistol according to the present invention and serves for further clarification of the invention. The temporal development of the spray cloud is shown in six pictures of FIG. 6 from the upper left to the lower right.

Upon spraying, paint droplets exit from the spray nozzle of the spray pistol with a high speed and contact the surface to be sprayed. Notwithstanding the detail whether with the selected spraying method atomized air is used or not, an air flow directed to the surface to be sprayed exits from the impulse exchange. This is turned around at the surface and moves about the spraying center in a circle outwardly, as shown in FIG. 6. According to the droplet spectrum, the smallest paint droplets are carried away by this air flow, which therefore do not remain adhered to the surface to be sprayed. This paint mist, which as previously noted, is designated as overspray, leaves upon free spraying of the actual coating region. The droplets in the overspray have an aerosol character, that is, they behave similarly to cigarette smoke. The material transport, therefore, is affected less by the heavy air than by thermal or other flow processes of the environment. Lastly, the overspray strays into the room and is broken down in regions nearly without air circulation over a longer time period. This can lead to a damaged surface of the job.

The basic principle of the mobile suctioning according to the present invention is to limit the overspray dispersion. By means of the encapsulation of the spraying pistol by means of the baffle or by means of the capsule, a small, movable quasi "spraying cabin" is produced, in which the spraying or flowing processes run.

Basically, two types of encapsulation can be selected. With a flat contact of the base surface, that is, when the capsule must not be moved relative to the surface to be sprayed, the capsule can be attached to the surface. By suitable sealing, then, the capsule can be closed hermetically to the environment and can prevent the overspray from exiting from the capsule.

If is necessary, however, to move the spraying capsule, that is, together with the spraying pistol, relative to the surface to be sprayed, then a gap between the capsule and the surface to be coated is advantageous. This is described next in detail with reference to FIGS. 7 and 8.

Figure 7:
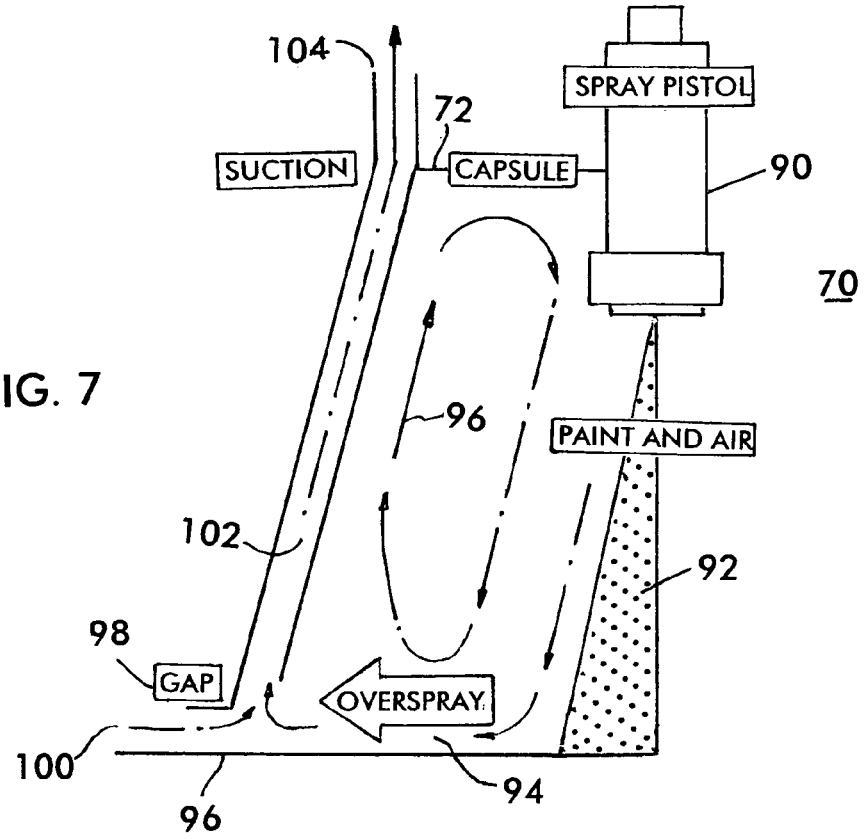
FIG. 7 shows a sectional view of a spray head according to a further exemplary embodiment of the present invention.

FIG. 7 shows a detail view of a spray head 70 according to an advantageous exemplary embodiment of the present invention. The spray head 70 has a spray pistol 90, which directs a jet of paint and air by means of a nozzle onto the surface 96 to be sprayed. As previously described with reference to FIG. 6, an overspray 94 forms, which is suctioned according to the present invention by means of a suction system. In order to permit the suctioning, a suction channel 102 is provided, which can be attached in the walls of the capsule 72 or also on the side walls of the capsule 2. The suction channel 102 then can have a coupling 104 for attachment of a suction tube, for example a tube 80.

In FIG. 7, no roller system 74 is provided. Admittedly, in this embodiment, the provision of a roller system 74 is advantageous in order to permit a defined gap 98 between the surface to be sprayed 96 and an edge in the capsule. In addition, the roller system 74 makes possible a simple movement of the spray head 70 parallel to the surface 96 to be sprayed.

As previously noted, a better part of the overspray 94 is suctioned off by means of the suction channel 102. Indeed, a part of the overspray remains in the volume of the capsule 72 and describes a circulation 96, which however, essentially has no negative affect on the quality of the application. By means of the encapsulation of the circulation 96 in the capsule 72, it is also ensured that no droplets exit the circulation 96 to the environment.

In order to permit that in spite of the gap 98, no overspray 94 exits from the capsule 72 or essentially, no overspray 94 exists from the capsule 72, according to the present invention, blocking air 100 is suctioned in through the gap 98 into the suction channel 102. In this manner, at the inlet of the suction channel 102, the blocking air from the outside and the overspray 94 collide, whereby a dispersion of the overspray 94 from the capsule is prevented and merely a dispersion of the overspray to the suction channel 102 is made possible. In this manner, it is ensured that the overspray remains essentially encapsulated in the capsule or is suctioned through the suction channel 102.

Figure 8:
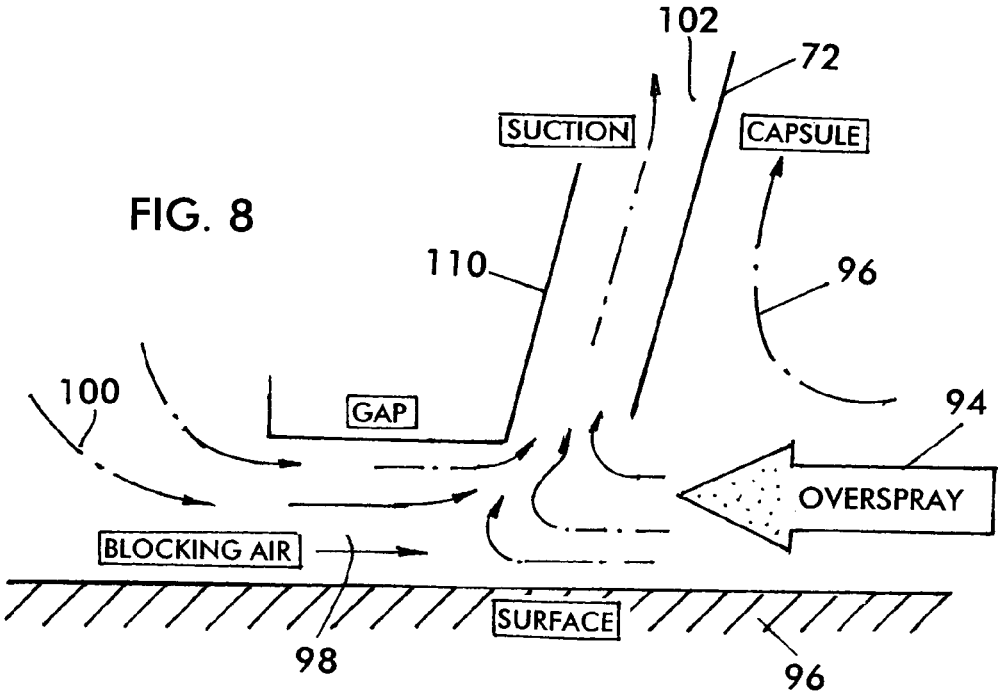
FIG. 8 shows a detail view of an exemplary embodiment of a capsule for a spray head according to an embodiment of the present invention.

FIG. 8 shows a detail view of a capsule 72 according to an embodiment of the present invention. The reference numeral 110 designates an outer wall of the suction channel 102, which according to this embodiment, is provided between an outer wall 72 of the capsule and the outer wall 110 of the suction channel 102. As can be seen in FIG. 8, the suction opening of the suction channel 102 is provided near the air gap 8, such that the air is suctioned in through the suction channel 102 from the outside of the spray head and the capsule 72 and the overspray 94. Since the blocking air 100 from the outside is directed counter to the direction of the overspray 94, both air flows collide in front of the inlet of the suction channel 102 and are suctioned by means of a vacuum pressure in the suction channel 102. The outer wall 110, the suction channel 102 and the gap 98 can be integrated or arranged in a suitable manner also in the capsule 72 or in the walls of the capsule 72. Likewise, a plurality of suction channels can be provided. A suction system arranged completely about the edge of the capsule can be advantageous.

In the embodiment shown in FIGS. 7 and 8, it is advantageous to structure the gap, the inlet of the suction channel and the capsule, such that the primary flows of the spray jet and the secondary flows are not disturbed by the impulse exchange. Advantageously, this makes possible the prevention of degradation of a sprayed image by a reciprocal disturbance of these flows. This can be adjusted, for example, by an adjustment of the suction pressure, the inner pressure in the capsule, the supply air, and the gap width.

Figure 9:
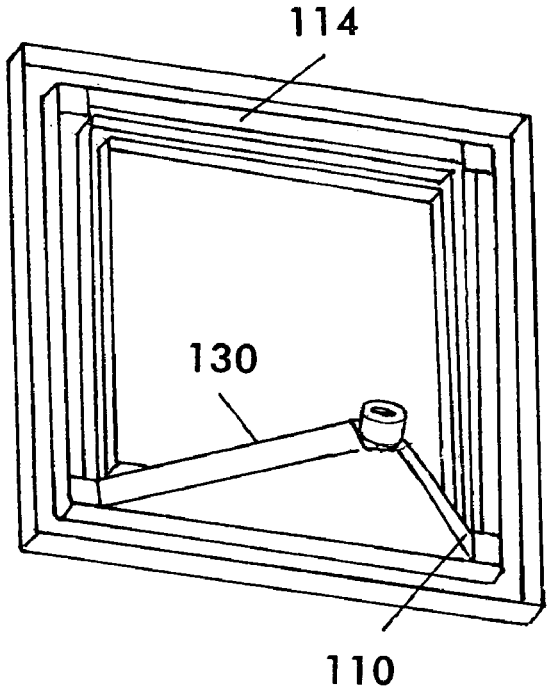
FIG. 9 shows a view of an exemplary embodiment of a suction assembly according to the present invention, which can be used, for example, in a spray head according to the present invention.
Figure 10:
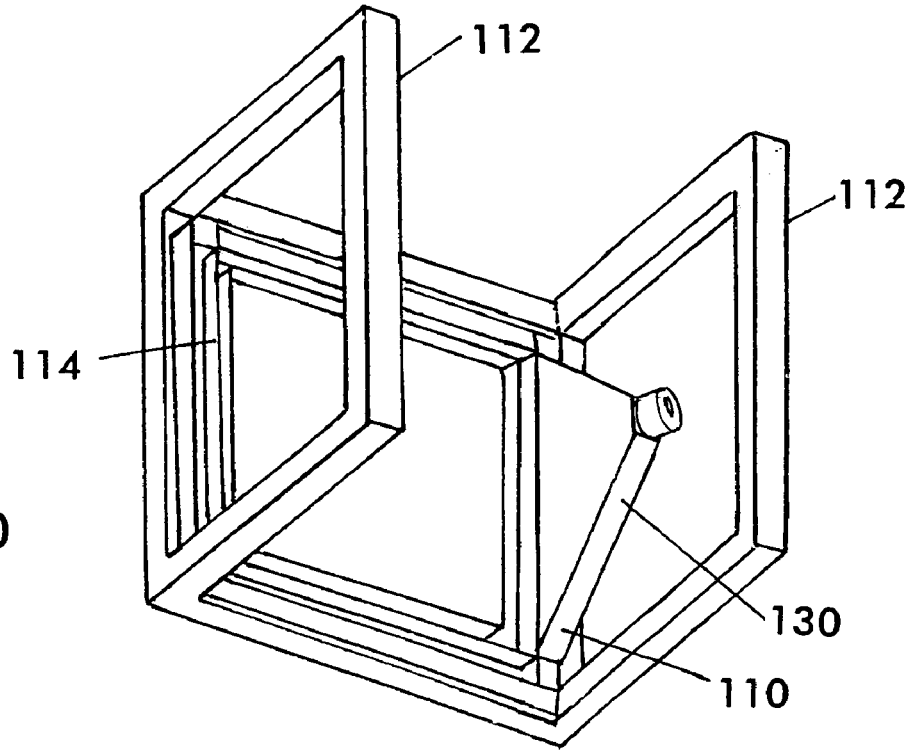
FIG. 10 shows a view of a further embodiment of a suction assembly according to the present invention, which can be used in a spray head according to the present invention.

FIGS. 9 and 10 show embodiments of suction systems according to the present invention.

In order to hold the capsule 72 and the suction funnel 130, according to the present invention, it is proposed to structure the suction front or gap surface by two U-profile frames. Outer dimensions of the edges can amount to 250×250 mm, for example. In the embodiment shown in FIG. 10, in addition, two grip brackets 112 are provided, whereby a distance between the grip brackets should not be too narrow according to the targeted capsule size or the goal weight, in order to permit easy manipulation.

As shown in FIGS. 9 and 10, the U-profiles can be arranged at a right angle to one another and can be connected by means of corner joints to one another. Likewise, for example, a traverse can be provided, which offers in connection with the corner joints and the U-profiles a constructively simple solution and ensures a sufficient rigidity. Moreover, a traverse, which can be provided for example between the brackets 112 as shown in FIG. 10, can be constructed for attachment of the spray pistol.

Figure 11:
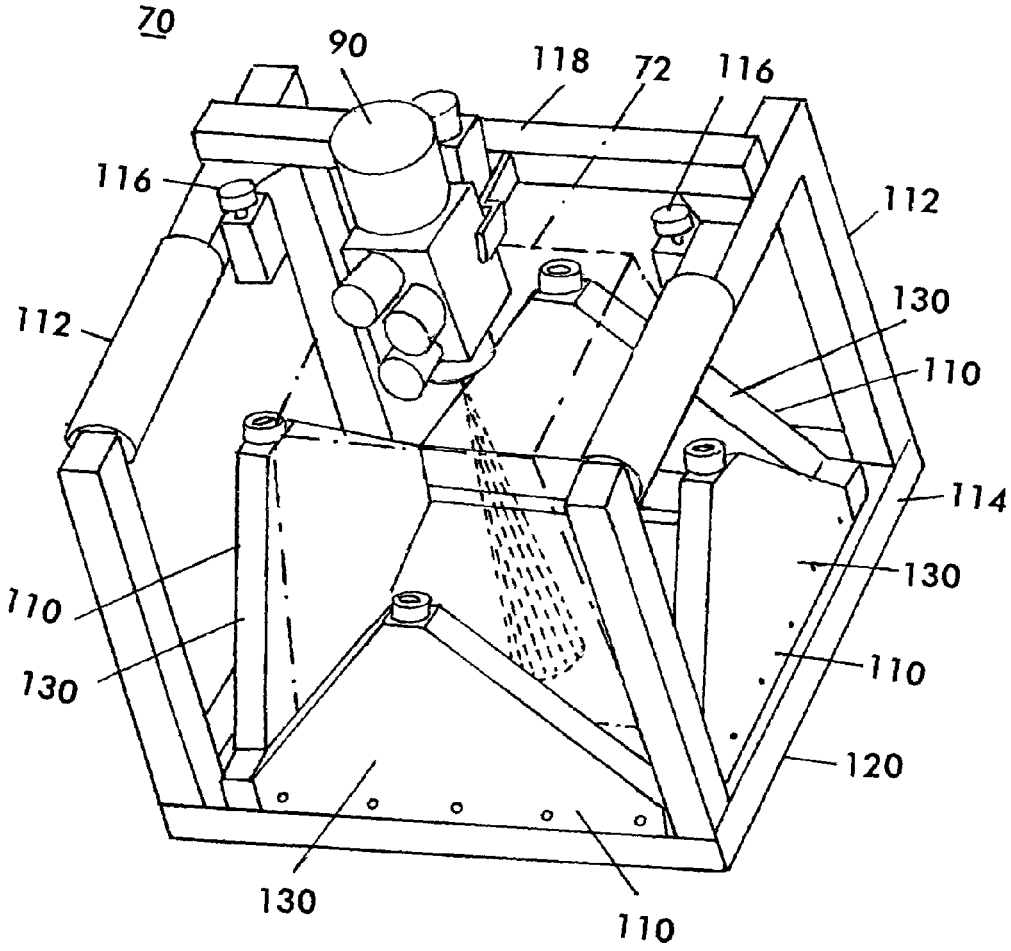
FIG. 11 shows a three-dimensional view of a further exemplary embodiment of a spraying device of the present invention.

FIG. 11 shows a further embodiment of a spray head 70 according to the present invention. As shown in FIG. 11, four individual suction funnels 130 are provided, which are arranged in U-profiles, as previously described with reference to FIGS. 9 and 10. The U-profiles are designated with reference numerals 114. In addition, handles or brackets 112 are provided, between which a traverse 118 is arranged, which are formed for holding the spray pistol 90.

Reference numeral 116 designates a control air button by means of which a control air can be adjusted. The control air, for example, can be for the spray pistol, but also can affect the suctioning. Reference numeral 72 in FIG. 11 designates the capsule. According to a variation of this embodiment, the capsule 72 can be made of Plexiglas. This is advantageous, so that an operator can start up the spray center and control the spraying process. In order to permit a defined gap of approximately 5 mm between the surface to be sprayed and the spray head 70 and to permit the moveability between the spray head and the surface, rollers can be arranged at three points of the structure.

It should be noted that elements and features of the embodiments shown in FIGS. 1 through 11 can be combined with one another and therefore, corresponding features of these individual embodiments can be combined by the practitioner.

In addition, it should be noted that the term "including" does not exclude other elements or steps and "a" or "one" does not exclude a plurality. In addition, it should be noted that the features or steps, which were described with reference to the above embodiments, also can be used in combination with other features or steps of other embodiments described above. Reference numerals in the claims are not to be viewed as limitations.

What is claimed is:

1. A spraying device comprising:

a baffle;

a spray head;

an extraction system; and a handle structured to provide manual operation of the spraying device;

wherein the spray head is arranged in the baffle and is formed to distribute droplets on a surface and the baffle is formed to obstruct the dispersion of droplets in at least one unwanted direction;

the baffle further comprising:

an inner wall;

an outer wall; and a suction channel formed between the inner wall and the outer wall such that the suction channel is formed as a portion of the extraction system;

the inner wall of the baffle defining a volume in the baffle to accommodate the surface to be sprayed with droplets where the droplets are sprayable into the volume through the spray head;

the spraying device is structured such that a a portion of the droplets introduced into the spraying device delineate a circulation; and the baffle further including at least one opening formed therein operable to provide air from outside the baffle;

the at least one opening forming a connection between the inner wall and the outer wall of the baffle such that the inner wall of the baffle is a greater distance from the surface to be sprayed than the outer wall of the baffle; and wherein a portion of the air located in the volume is drawn off via the extraction system through the suction channel and the air contains droplets suspended therein as a mist.

2. The spraying device of claim 1, wherein a suction opening is provided in the region of the volume defined by the inner wall of the baffle, and is arranged a first distance from the spray head in a dispersion axis direction of the droplets;

and a second distance from the spray head in a direction perpendicular to the dispersion axis of the droplets; and wherein the suction opening cooperates with the extraction system to draw off the portion of the air in the volume.

3. The spraying device of claim 1, wherein the baffle is bell-shaped.

4. The spraying device of claim 1, wherein the spraying device is coupled with a base station comprising:

an exhaust fan;

at least one exchangeable filter unit;

at least one valve element;

at least one control element;

at least one operator control;

a material pressure vessel;

at least one connection for compressed air; and at least one connection for a supply voltage.

5. The spraying device of claim 1, further comprising:

a rolling system at the spray head.

6. A method of spraying with a spraying device, the method comprising the steps of:

spraying droplets on a surface by means of a spray head, wherein the spraying device is holdable and controllably moveable by means of a handle;

providing a baffle for preventing dispersion of droplets in at least one direction supplying air through at least one opening in the baffle; and sucking at least a portion of the air in the baffle out of the baffle by means of an extraction system though a suction channel formed between an inner wall and an outer wall of the baffle.

7. The method of claim 6, further comprising the steps of:

extracting droplets from a volume defined in the baffle through a suctioning opening in cooperation with the suction channel;

wherein the suctioning opening is provided at a first distance from the spray head in a dispersing direction of the droplets; and wherein the suctioning opening is provided at a second distance from the spray head in a direction perpendicular to the dispersing direction.

8. A spraying device comprising:

a baffle;

a spray head arranged in the baffle and formed to distribute droplets on a surface, where the baffle is formed to obstruct the dispersion of droplets in at least one unwanted direction;

wherein the spraying device is formed, such that a portion of the droplets introduced into the spraying device delineate a circulation and the spraying device is manually operatable; and a base station coupled to the spray head and the baffle, the base station further comprising:

an exhaust fan;

at least one exchangeable filter unit;

at least one valve element;

at least one control element;

at least one operator control;

a material pressure vessel;

at least one connection for compressed air; and at least one connection for a supply voltage.

9. The spraying device of claim 8, wherein the baffle further comprises:

an inner wall; and an outer wall;

wherein the inner wall of the baffle defines a volume that accommodates the surface to be sprayed; and wherein the droplets are sprayable into the volume through the spray head.

10. The spraying device of one claim 9, further comprising:

an extraction system;

wherein a portion of the air in the volume is drawn off by the extraction system; and wherein the air contains the droplets suspended therein as a mist.

11. The spraying device of claim 9, wherein the baffle further comprises:

at least one opening;

wherein the opening is an air supply providing air from outside of the baffle, and wherein the opening forms a connection between the inner wall and the outer wall of the baffle.

12. The spraying device of claim 10, further comprising a suction opening provided in the region of the volume;

wherein the suction opening is arranged a first distance from the spray head in a dispersion direction of the droplets and a second distance away from the spray head in a direction perpendicular to the dispersion axis of the droplets; and wherein the suction opening cooperates with the extraction system to draw off a portion of the air in the baffle.

13. The spraying device of claim 8, further comprising a handle, wherein the handle is mounted on the spraying device; and wherein the baffle is bell-shaped.

14. The spraying device of claim 8, further comprising:

a rolling system at the spray head.

15. A method of spraying with a spraying device comprising the steps of:

spraying droplets onto a surface by means of a spray head, wherein a portion of the droplets move with a circular motion;

providing a baffle for preventing dispersion of droplets in at least one direction, the spraying device being manually operated;

extracting droplets from a volume defined by the baffle through a suctioning opening;

wherein the suctioning opening is provided at a first distance from the spray head in a dispersing direction of the droplets and a second distance from the spray head in a direction perpendicular to the dispersing direction;

sucking the extracted droplets by means of an exhaust fan; and cleaning the extracted droplets from the air by means of a filter.

16. A spraying device comprising:

a baffle;

a spray head arranged in the baffle and operable to distribute droplets on a surface; and an extraction system, wherein the baffle is formed to obstruct the dispersion of droplets in at least one unwanted direction;

the baffle further comprising:

an inner wall defining a volume in the baffle to accommodate the surface to be sprayed with droplets;

an outer wall; and a suction channel formed between the inner wall and the outer wall such that the suction channel is formed as a portion of the extraction system;

the droplets are sprayable into the volume through the spray head; and wherein a portion of the air located in the volume of the ballast is drawn off via the extraction system through the suction channel and wherein the air contains a plurality of droplets suspended in the air as a mist.

* * * * *